US005143377A

United States Patent [19]

Oka et al.

[11] Patent Number: 5,143,377

[45] Date of Patent: Sep. 1, 1992

[54] GOLF BALL

[75] Inventors: Kengo Oka, Kobe; Shinji Ohshima, Nishinomiya, both of Japan

[73] Assignee: Sumitomo Rubber Industries, Ltd., Hyogo, Japan

[21] Appl. No.: 739,458

[22] Filed: Aug. 2, 1991

[30] Foreign Application Priority Data

Feb. 4, 1991 [JP] Japan ..... 3-035400

[51] Int. Cl.[5] ..... A63B 37/12

[52] U.S. Cl. ..... 273/232; 40/327

[58] Field of Search ..... 273/232, 62, 233; 40/327

[56] References Cited

U.S. PATENT DOCUMENTS 3,819,190 6/1974 Nepela et al. .
4,284,276 8/1981 Worst ..... 273/232
4,991,852 2/1991 Pattison ..... 273/232
5,009,428 4/1991 Yamagishi et al. ..... 273/232

FOREIGN PATENT DOCUMENTS 2194457 3/1974 France .
62-47379 1/1987 Japan .
64-8983 7/1989 Japan .
2176409 12/1986 United Kingdom .

*Primary Examiner*—William H. Grieb
*Assistant Examiner*—Steven B. Wong
*Attorney, Agent, or Firm*—Birch, Stewart, Kolasch & Birch

[57] ABSTRACT

A golf ball having circular dimples and noncircular dimples arranged in different percentages depending on the spherical zones, whereby a favorable aerodynamic property is obtained by eliminating the difference in trajectories between line hitting and face hitting.

3 Claims, 14 Drawing Sheets

GOLF BALL

BACKGROUND OF THE INVENTION

1. Field of the Invention

The present invention relates to a golf ball, and more particularly, to the golf ball having an improved aerodynamic symmetrical property which can be accomplished by arranging dimples of different surface configurations on the surface thereof.

2. Description of the Related Arts

Normally 280 to 540 dimples are formed on the surface of the golf ball. The function of dimples is to reduce pressure resistance to the golf ball during flight and improve the dynamic lift thereof. More specifically, in order to lift a golf ball high in the air, the separation point between the air and the upper surface of the ball is required to be toward the back of the ball as possible compared with the separation point between the air and the lower surface thereof so as to make air pressure existing above the ball smaller than that which exist below the ball. In order to accelerate the separation of air existing above it from the upper surface thereof, it is necessary to make the air current along the periphery of the ball turbulent. In this sense, a dimple which makes the air current around the golf ball turbulent, is aerodynamically superior.

Since the golf ball is molded by a pair of upper and lower semispherical molds having dimple patterns, dimples cannot be arranged on the parting line corresponding to the connecting face of the upper and lower molds. Therefore, one great circle path corresponding to the parting line which does not intersect any dimples is formed on the surface of the golf ball.

As the surface configuration of the dimple, circular, elliptic, polygonal or the like is adopted. The golf ball has dimples of the same surface configuration or various surface configurations formed on the surface thereof.

In view of the dimple effect, the surface of the golf ball may be divided into a spherical zone in the vicinity of a great circle path, not intersecting any dimples and other spherical zone with respect to the great circle path. According to conventional methods of arranging dimples of different surface configurations, both spherical zones have the same dimple arrangement, i.e., dimples which are uniformly arranged throughout the surface of the golf ball.

When dimples of different configurations are arranged on the surface of the golf ball uniformly in both spherical zones, the dimple effect in the spherical zone in the vicinity of the great circle path is differentiated from the other spherical zone due to the existence of the great circle path. Consequently, the following problem occurs in the aerodynamic symmetrical property of the golf ball.

It is preferable that the golf ball flies in the same trajectory each time it flies. That is, preferably, the trajectory height, flight time, and flight distance of the golf ball is the same, respectively, regardless of whether or not its rotational axis in its backspin coincides with the great circle path. But actually, dimple effect varies according to a rotational axis, namely, whether or not a circumference which rotates fastest in its backspin coincides with the great circle path.

More specifically, in line hitting, i.e., when the golf ball rotates in its backspin such that a circumference which rotates fastest in its backspin coincides with the great circle path, the dimple effect of making air current around the golf ball turbulent is smaller than the dimple effect obtained in face hitting, i.e., when the golf ball rotates in its backspin such that a circumference which rotates fastest in its backspin does not coincide with the great circle path. That is, the trajectory height of the golf ball is lower and consequently the flight time thereof in line hitting is shorter than those in face hitting.

If the golf ball has a different flight performance according to a rotational axis, i.e., if the golf ball has an unfavorable aerodynamic property, a player's ability cannot be displayed.

In order to solve the above-described problem, methods for manufacturing golf balls having no great circles are proposed, for example, in Japanese Patent Laid-Open Publication 64-8983 and Japanese Patent Laid-Open Publication No. 62-47379. However, due to various problems, these methods are incapable of putting golf balls on the market. Such being the case, golf balls commercially available have at least one great circle path.

SUMMARY OF THE INVENTION

It is an object of the present invention to provide a golf ball, having at least one great circle path formed on the surface thereof, in which a favorable aerodynamic property is obtained by eliminating the difference in trajectories between line hitting and face hitting.

In accomplishing these and other objects, a golf ball according to the present invention has dimples of different configurations, namely, circular and noncircular dimples having the effect of making the air current around the surface of the ball turbulent. Circular dimples and noncircular dimples are arranged in a different percentage depending on spherical zones, namely, in an (L) spherical zone in the vicinity of the great circle and an the (F) spherical zone other than (L) spherical zone. That is, in (L) spherical zone, uncircular dimples are arranged in a percentage higher than circular dimples while in (F) spherical zone, circular dimples are arranged in a percentage higher than noncircular dimples. Thus, the dimple effect of the (L) spherical zone is equal to that of the (F) spherical zone.

More specifically, a golf ball according to the present invention has dimples on the surface thereof and at least one great circle path which does not intersect the dimples in which supposing that a spherical zone ranging from the great circle to each circumference formed in correspondence with a central angle of less than approximately 15° with respect to the great circle is represented as an (L) spherical zone and a spherical zone other than the (L) spherical zone is represented as an (F) spherical zone, noncircular dimples are arranged in the (L) spherical zone in an amount more than 60% of all dimples arranged in the (L) spherical zone and circular dimples are arranged in the (F) spherical zone in an amount more than 60% of all dimples arranged in the (F) spherical zone. The surface configuration of each of the noncircular dimples is a regular polygonal.

According to the golf ball of the present invention, the dimple effect of (L) zone is increased by arranging noncircular dimples in (L) spherical zone in an amount more than 60% all dimples arranged in the (L) spherical zone and the circular dimples in the (F) spherical zone in an amount more than 60% of all dimples arranged in the (F) spherical zone. Thus, the dimple effect reduced in the (L) zone by the great circle is compensated so that the dimple effect of the (L) spherical zone is equal to that of the (F) spherical zone.

The reason the dimple effect in (L) spherical zone is increased is that a noncircular dimple has the effect of making air current more turbulent than a circular dimple as described above. That is, the air current at the periphery of the circular dimple, for example, d-1 as shown in FIG. 1 is smooth while the air current the periphery of the noncircular dimples, for example, d-2, d-3, and d-4 as shown in FIG. 2, 3, and 4, respectively make the air current turbulent when air current runs against the edge of the noncircular dimple.

According to the above construction, when the golf ball is line-hit, i.e., when it rotates about a rotational axis, the circumference of which coincides with the great circle, the dimple effect of the (L) spherical zone can be improved because noncircular dimples are arranged in the vicinity of the great circle in more than 60% of all dimples arranged therein. Thus, the trajectory height, flight time, and flight distance of the golf ball in line hitting are similar to those in face hitting. That is, the golf ball has an equal flight performance wherever it is hit, namely, irrespective of the rotational axis in its backspin.

The central angle made by a circumference which divides the golf ball into the (L) spherical zone and the (F) spherical zone is not limited to 15°, but is determined by the number of great circles. If one to two great circles are formed on the surface of the golf ball, preferably, the central angle of the circumference is 20° while if three great circles are formed on the surface thereof, the line connecting the circumference and the center of the golf ball with each other makes an angle of 10° with the line connecting the center of the golf ball and each great circle with each other. Since the area of the (L) spherical zone increases with the increase in the number of great circles, it is advantageous to reduce the area of each (L) spherical zone so that the golf ball has a favorable aerodynamic property. Accordingly, the central angle of each circumference is decreased from 20° to 10° with an increase in the number of great circle paths.

The dimple arranged in the (L) spherical zone means that the center of the dimple is positioned in the (L) spherical zone and similarly, the dimple arranged in the (F) spherical zone means that the center of the dimple is positioned in the (F) spherical zone. The center of a noncircular dimple as shown in FIG. 4 is the center of gravity of the surface configuration thereof.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
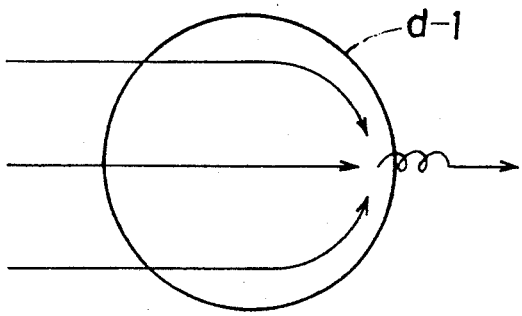
FIG. 1 is a schematic view showing the air current on a circular dimple.
Figure 2:
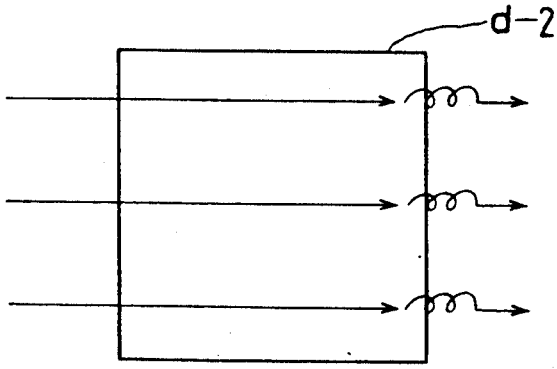
FIG. 2 is a schematic view showing the air current on a noncircular dimple.
Figure 3:
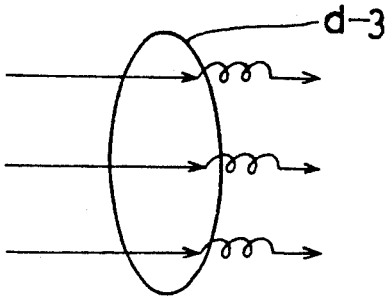
FIG. 3 is a schematic view showing the air current on a noncircular dimple.
Figure 4:
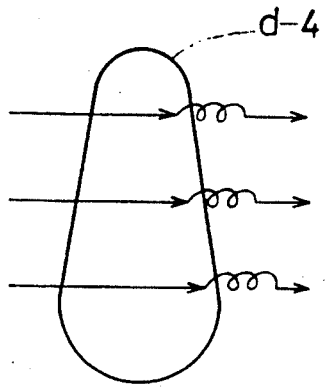
FIG. 4 is a schematic view showing the air current on a noncircular dimple.

Before the description of the present invention proceeds, it is to be noted that like parts are designated by like reference numerals throughout the accompanying drawings.

The embodiments of the present invention will be described with reference to the accompanying drawings.

Figure 5:
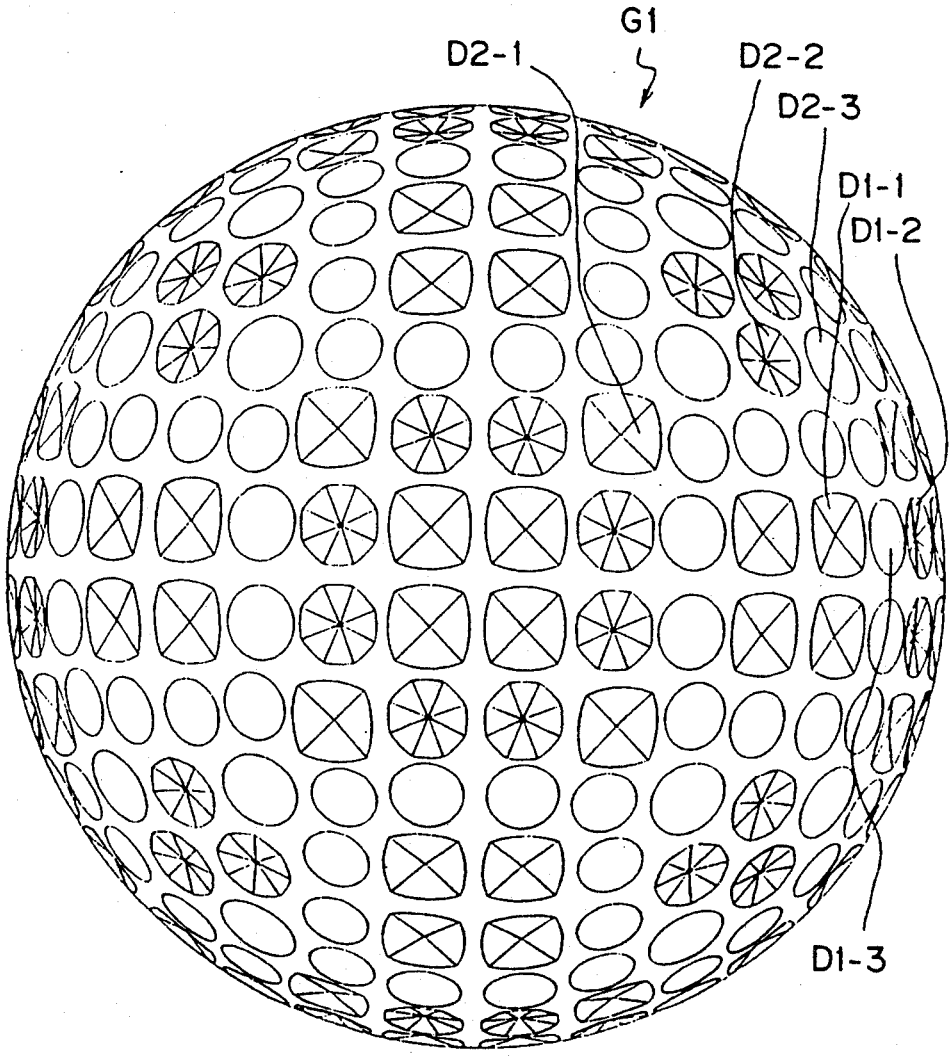
FIG. 5 is a front view showing a golf ball according to a first embodiment of the present invention.
Figure 6:
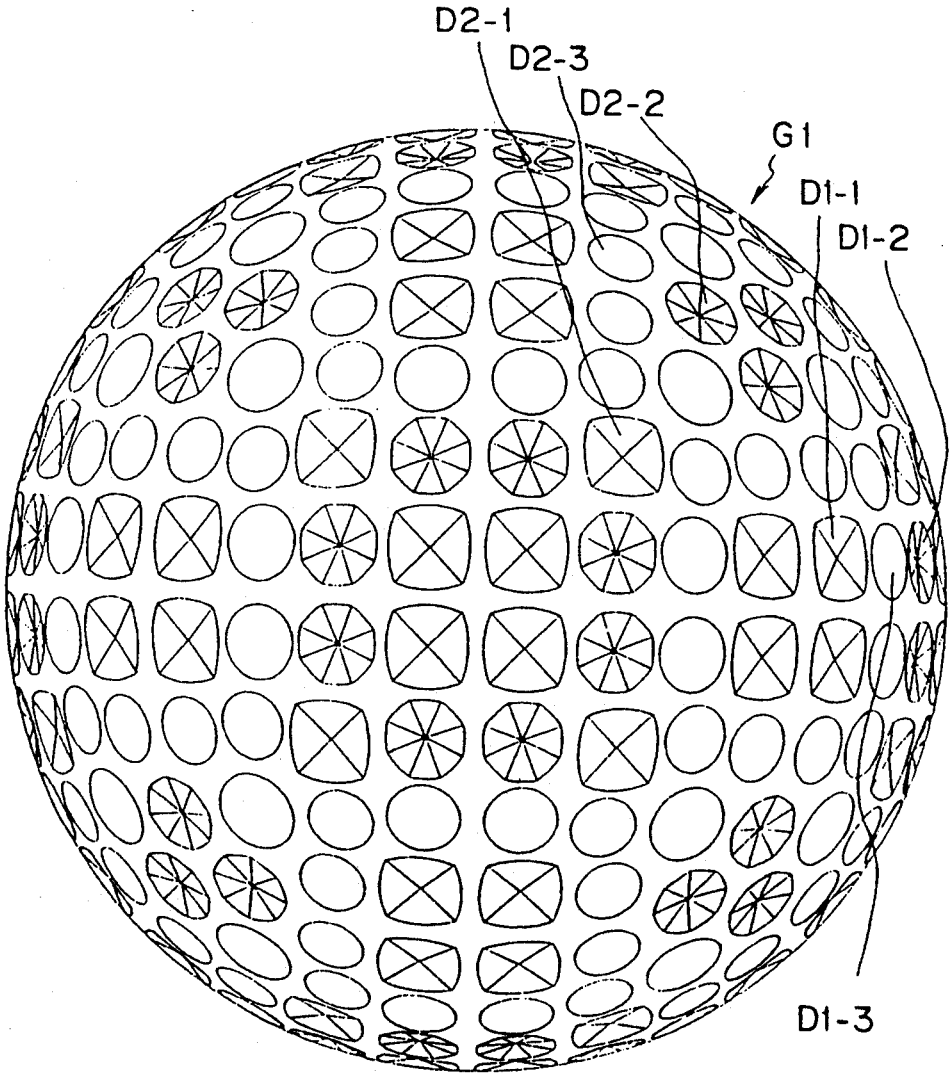
FIG. 6 is a plan view of the golf ball shown in FIG. 5.
Figure 7:
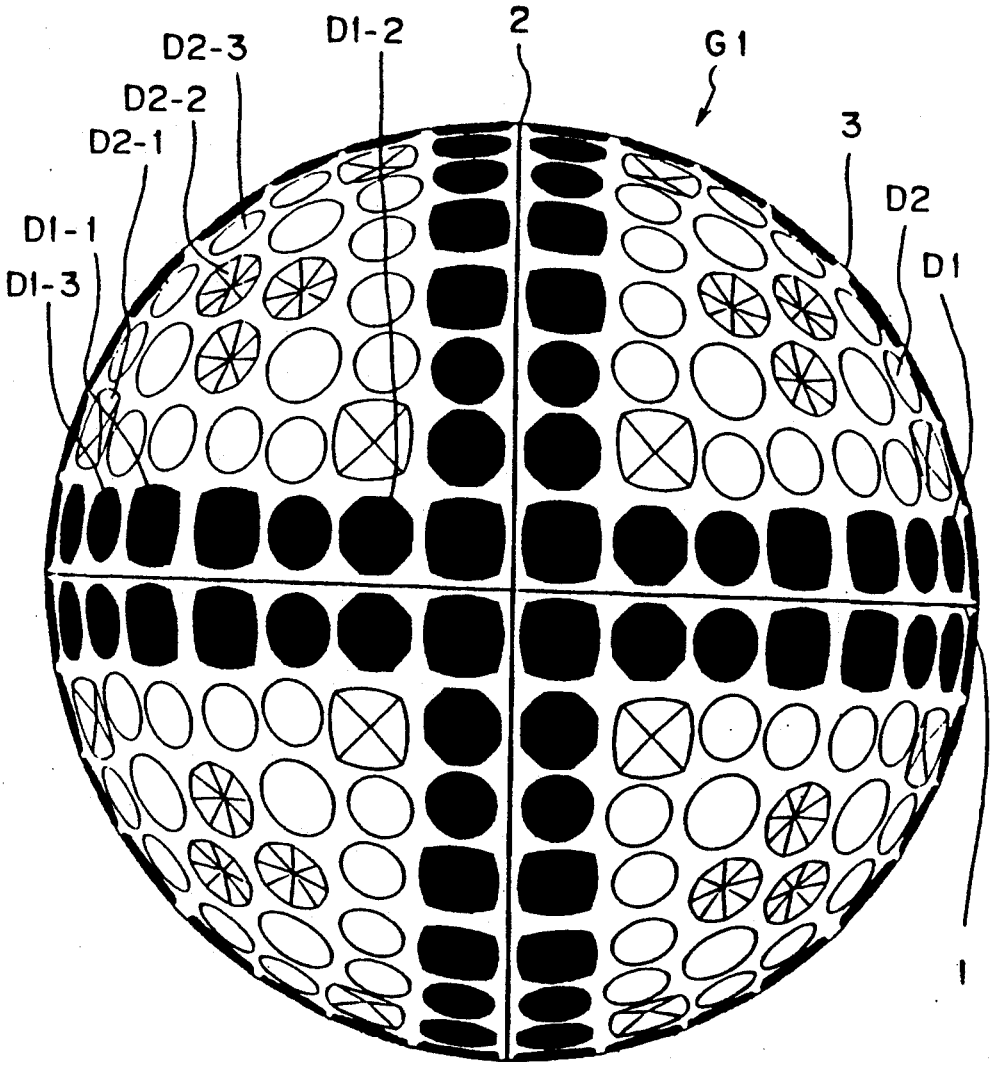
FIG. 7 is a front view showing an L spherical zone and an F spherical zone of the golf ball according to the first embodiment of the present invention.

Referring to FIGS. 5, 6, and 7 showing a golf ball G1 in accordance with a first embodiment of the present invention, dimples of the golf ball G1 are arranged based on a regular octahedral arrangement, i.e., the spherical surface of the golf ball G1 is divided into areas corresponding to the faces of a regular octahedron to form eight identical spherical equilateral triangles. The golf ball G1 has three great circle paths 1, 2, and 3 nonintersecting dimples.

Figure 8:
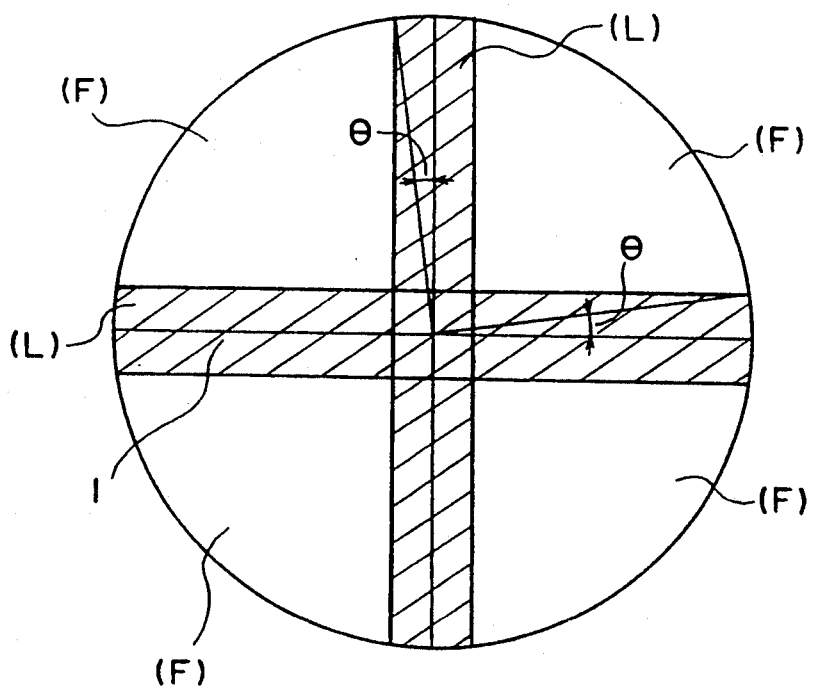
FIG. 8 is a descriptive view for describing the boundary line between the L spherical zone and the F spherical zone.

Since the golf ball G1 has three great circles, the central angle of each boundary circumference (X) dividing the surface of the golf ball into two zones, an (L) spherical zone and an (F) spherical zone is set to $\theta = 10°$ as shown in FIG. 8 for the reason described previously. More specifically, the line connecting each boundary circumference (X) with the center of the golf ball makes a 10° angle with the line connecting each great circle path 1, 2, and 3 with the center of the golf ball G1. The (L) zone ranges from each great circle path 1, 2, and 3 to each boundary circumference (X). The (F) zone is the region other than the (L) zone. As shown in FIG. 7, dimples D1 arranged in the (L) zone are black while dimples D2 arranged in (F) zone are white.

The number of dimples D1 arranged in the (L) zone is 168 and that of dimples D2 arranged in the (F) zone is also 168, totalling 336 as shown in Table 1. The number of noncircular dimples, namely, square dimples D1-1 or regular octagonal dimples D1-2 is 120 which is 71% of dimples D1 arranged in the (L) zone while the number of circular dimples D1-3 arranged in the (L) zone is 48 which is 29% of dimples D1. The number of noncircular dimples, namely, square dimples D2-1 or regular octagonal dimples D2-2 is 48 which is 29% of dimples D2 arranged in the (F) zone while the number of circular dimples D2-3 in the (F) zone is 120 which is 71% or the dimples D2.

TABLE 1

| | number of dimples in embodiment and comparative example | | | | | | | | |
|---|---|---|---|---|---|---|---|---|---|
| | boundary between L zone and F zone | number of great circle paths | total number of dimples | number of dimples in L zone | | | number of dimples in F zone | | |
| | | | | uncircular | circular | total | uncircular | circular | total |
| first embodiment | 10° | 3 | 336 | 120 (71%) | 48 (29%) | 168 | 48 (29%) | 120 (71%) | 168 |
| second embodiment | 20° | 1 | 332 | 210 (100%) | 0 (0%) | 120 | 80 (38%) | 132 (62%) | 212 |
| first comparative example | 10° | 3 | 336 | 72 (43%) | 96 (57%) | 168 | 48 (29%) | 120 (71%) | 168 |
| second comparative example | 20° | 1 | 332 | 120 (100%) | 0 (0%) | 120 | 212 (100%) | 0 (0%) | 212 |

As apparent from the above description, according to the golf ball G1 of the first embodiment, in the (L) zone, noncircular dimples are arranged more than circular dimples while in (F) zone, the number of noncircular dimples are less than that of circular dimples so that air current in the periphery of the (L) zone is more turbulent than that in the periphery of the (F) zone.

Figure 9:
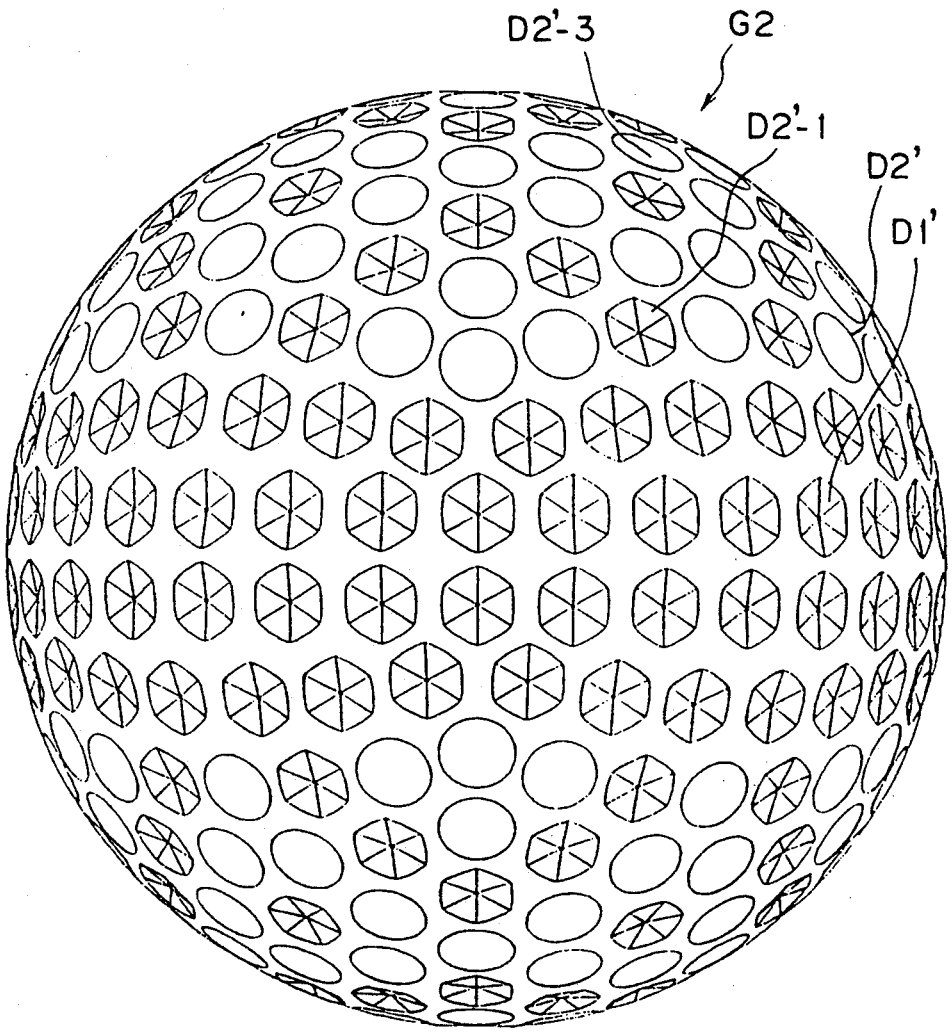
FIG. 9 is a front view showing a golf ball according to a second embodiment of the present invention.
Figure 10:
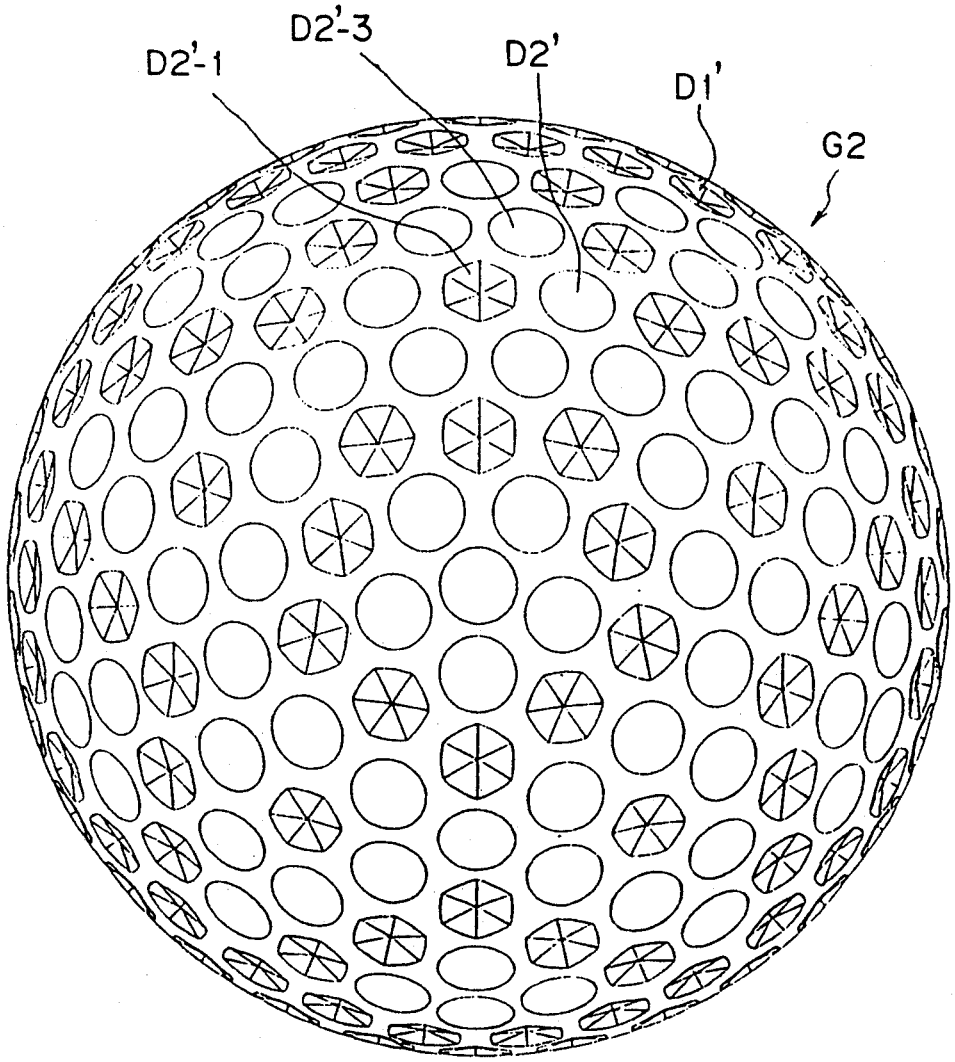
FIGS. 10 is a plan view of the golf ball shown in FIG. 9.
Figure 11:
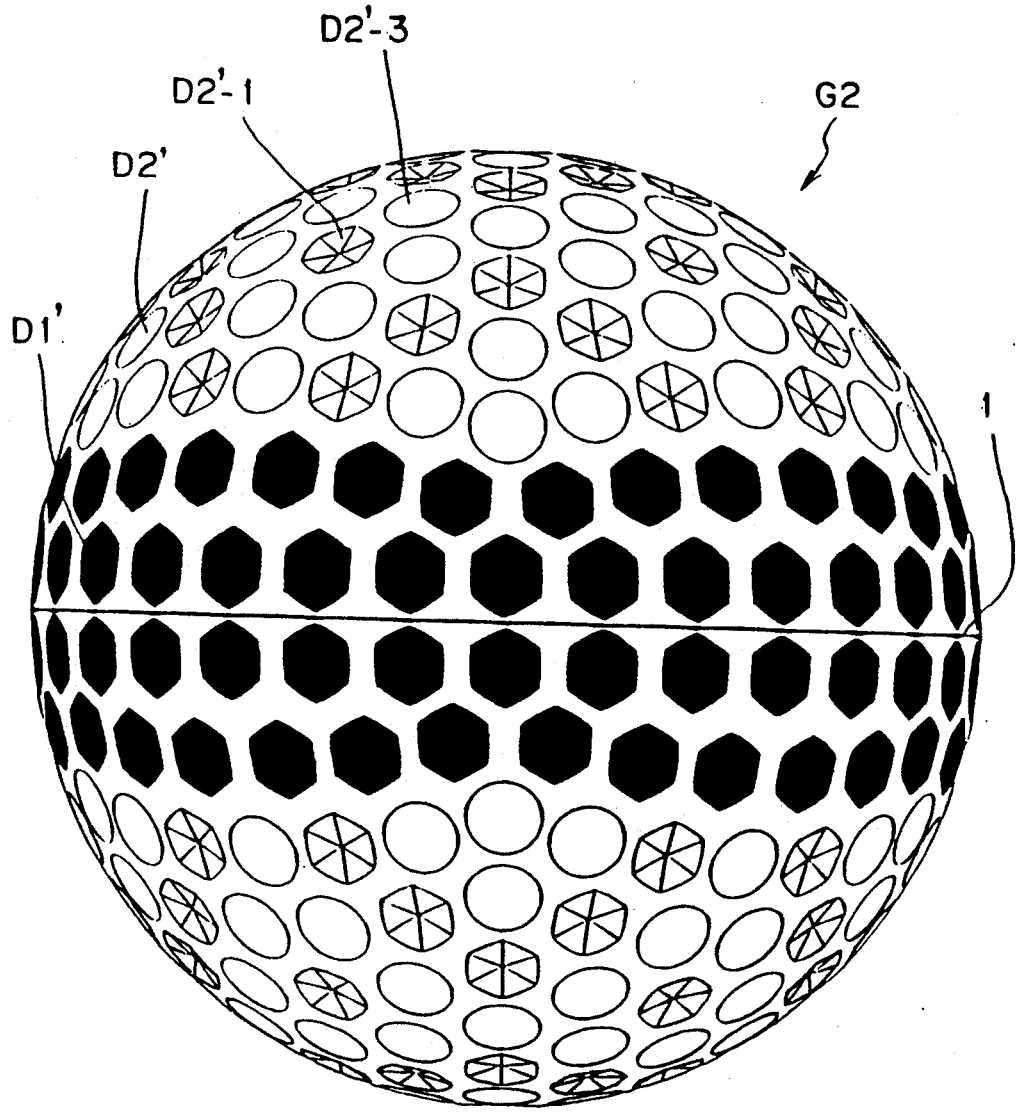
FIG. 11 is a front view showing L spherical zone and F spherical zone of a golf ball according to the second embodiment of the present invention.

Referring to FIGS. 9, 10, and 11, a golf ball according to a second embodiment of the present invention is described below. Dimples of a golf ball G2 are arranged on the surface thereof based on a regular icosahedral arrangement conventionally used, i.e., the spherical surface of the golf ball G2 is divided into areas corresponding to the faces of a regular icosahedron to form 20 identical spherical equilateral triangles. The golf ball G2 has one great circle path 1 corresponding to the parting line. For the reason described previously, the central angle of each boundary circumference (X dividing the surface of the golf ball into two zones, the (L) spherical zone and the (F) spherical zone is set to $\theta=20°$. More specifically, the line connecting each boundary circumference (X) with the center of the golf ball G2 makes 20° with the line connecting the great circle path 1 with the center of the golf ball. As shown in FIG. 11, dimples D1' arranged in the (L) zone are black while dimples D2' arranged in the (F) zone are white.

The number of dimples D1' arranged in the (L) zone is 120 and that of dimples D2' arranged in the (F) zone is 212, totalling 332 as shown in Table 1. The dimples D1' arranged in the (L) zone are all uncircular dimples, namely, regular hexagonal dimples while the number of uncircular dimples, namely, regular hexagonal dimples is 80 which is 38% of dimples D2' arranged in the (F) zone and the number of circular dimples is 132 which is 62% of the dimples D2' arranged in the (F) zone.

As apparent from the above description, according to the golf ball G2 of the second embodiment, only noncircular dimples are arranged in (L) zone while circular dimples are arranged more than noncircular dimples in the (F) zone so that the air current the periphery of the (L) zone is more turbulent than that at the periphery of the (F) zone.

According to the first and second embodiments, polygonal dimples such as square, regular octagonal or regular hexagonal dimples are used as noncircular dimples. This is because these regular polygonal dimples have more favorable symmetrical properties than dimples of other noncircular configurations and act on air current irrespective of the direction thereof.

Since dimples are formed on the spherical surface of the golf ball, the sides of a regular polygonal dimple are all spherical. But according to the present invention, a dimple which is a regular polygonal when it is viewed along the normal line to the curve of the golf ball at a given point is regarded as a regular polygonal dimple.

In order to examine the operation and effect of the aerodynamic property of the golf ball according to the present invention, first comparative example golf balls corresponding to the first embodiment and second comparative example golf balls corresponding to the second embodiment were prepared.

Figure 12:
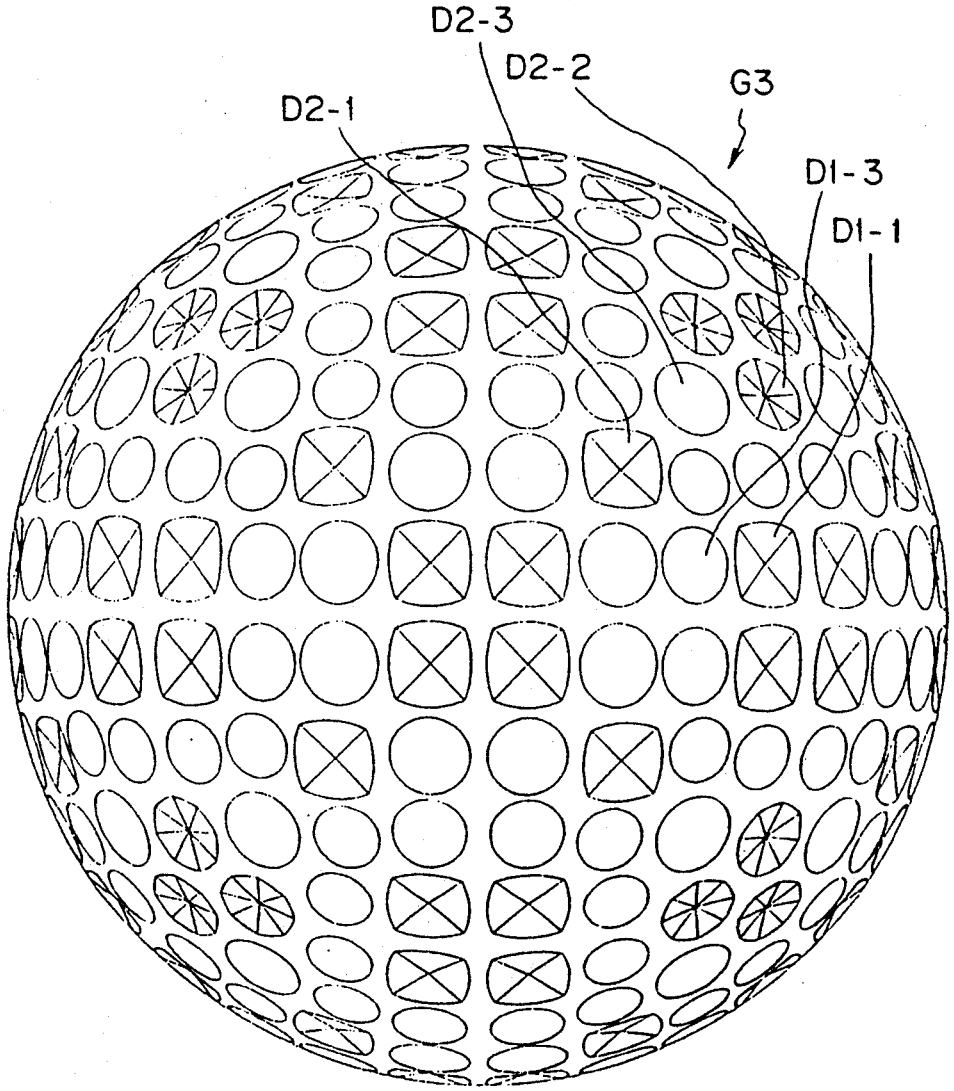
FIG. 12 is a front view showing a golf ball according to a first comparative example.
Figure 13:
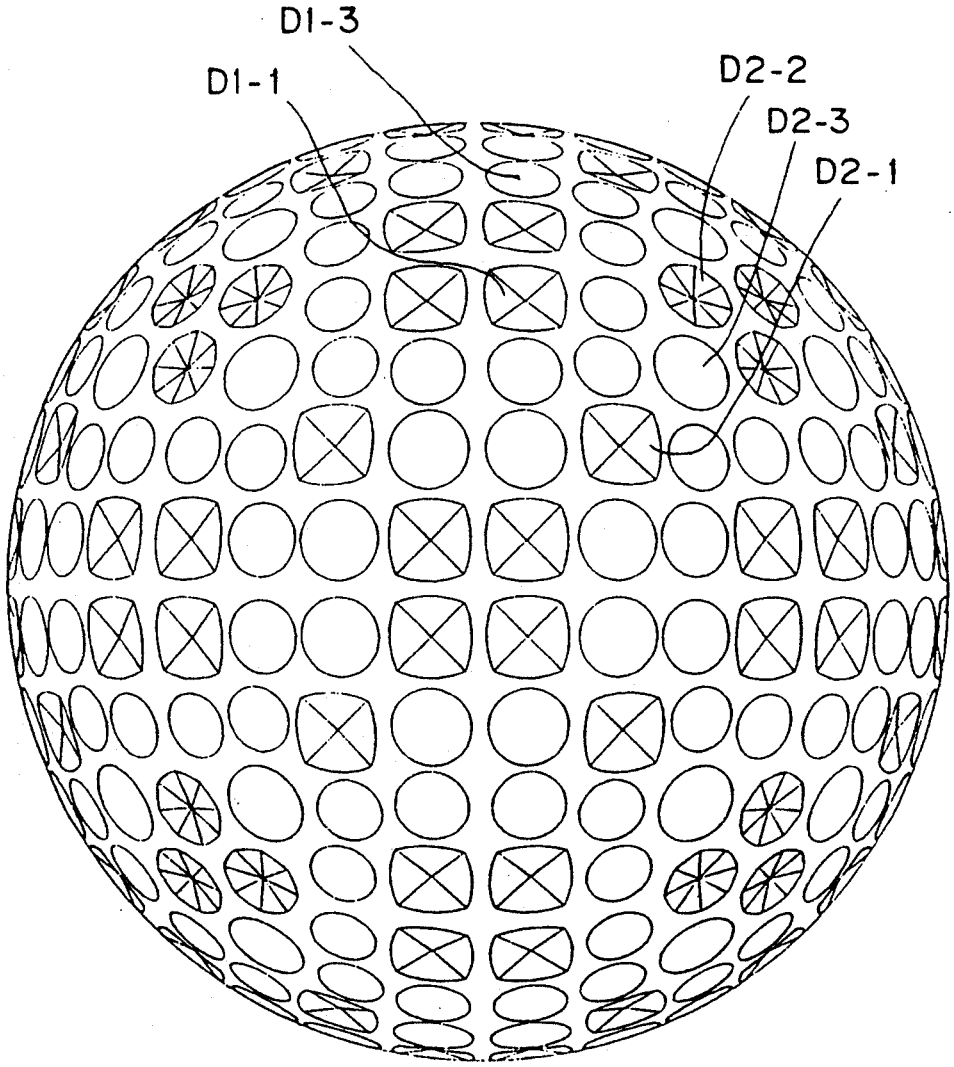
FIG. 13 is a plan view of the golf ball shown in FIG. 12.
Figure 14:
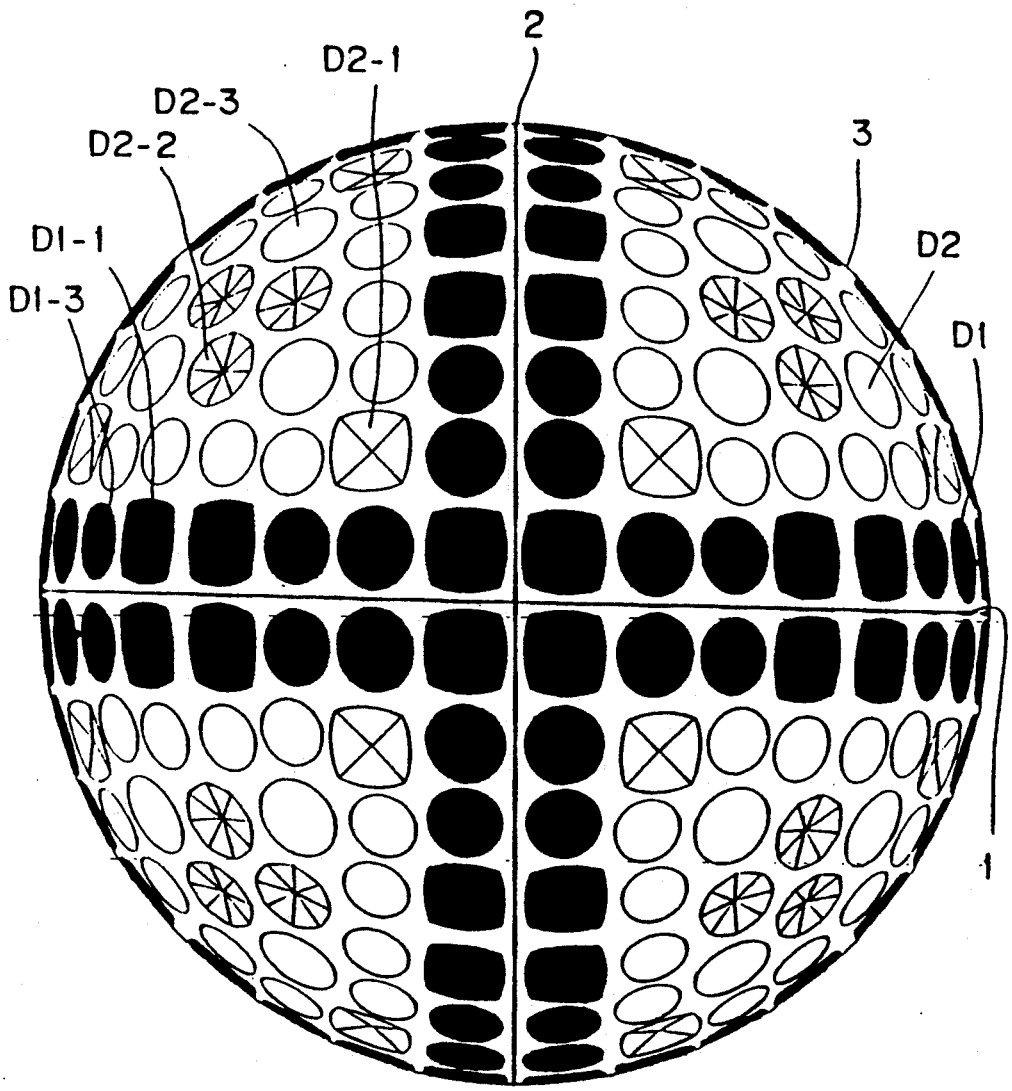
FIG. 14 is a front view showing the L spherical zone and the F spherical zone of the golf ball according to the first comparative example.

Referring to FIGS. 12, 13, and 14 showing a golf ball G3 according to a first comparative example, dimples of the golf ball G3 are arranged based on a regular octahedral arrangement and has three great circle paths 1, 2, and 3 of nonintersecting dimples, similarly to the first embodiment. Therefore, the central angle of each boundary circumference dividing the surface of the golf ball G3 into two zones, the (L) spherical zone and the (F) spherical zone is set to $\theta=10°$ similarly to the first embodiment. As shown in FIG. 14, dimples D1 arranged in the (L) zone are black while dimples D2 arranged in the (F) zone are white.

As shown in Table 1, 168 dimples are arranged in the (L) zone and the (F) zone of the first comparative example the golf ball G3, respectively, totalling 336 similarly to the first embodiment. The number of noncircular dimples, namely, square dimples D1-1 arranged in the (L) zone is 72 which is 43% of dimples D1 arranged therein while the number of circular dimples D1-3 arranged in the (L) zone is 96 which is 57% of dimples D1 arranged therein. The number of noncircular dimples, namely, square dimples D2-1 or regular octagonal dimples D2-2 arranged in the (F) zone is 48 which is 29% of dimples D2 arranged therein while the number of circular dimples D2-3 arranged in the (F) zone is 120 which is 71% of dimples D2 arranged therein. In the golf ball G3 of the first comparative example, circular dimples having a smaller effect of making air current turbulent are arranged more than noncircular dimples both in the (L) and (F) zones.

Figure 15:
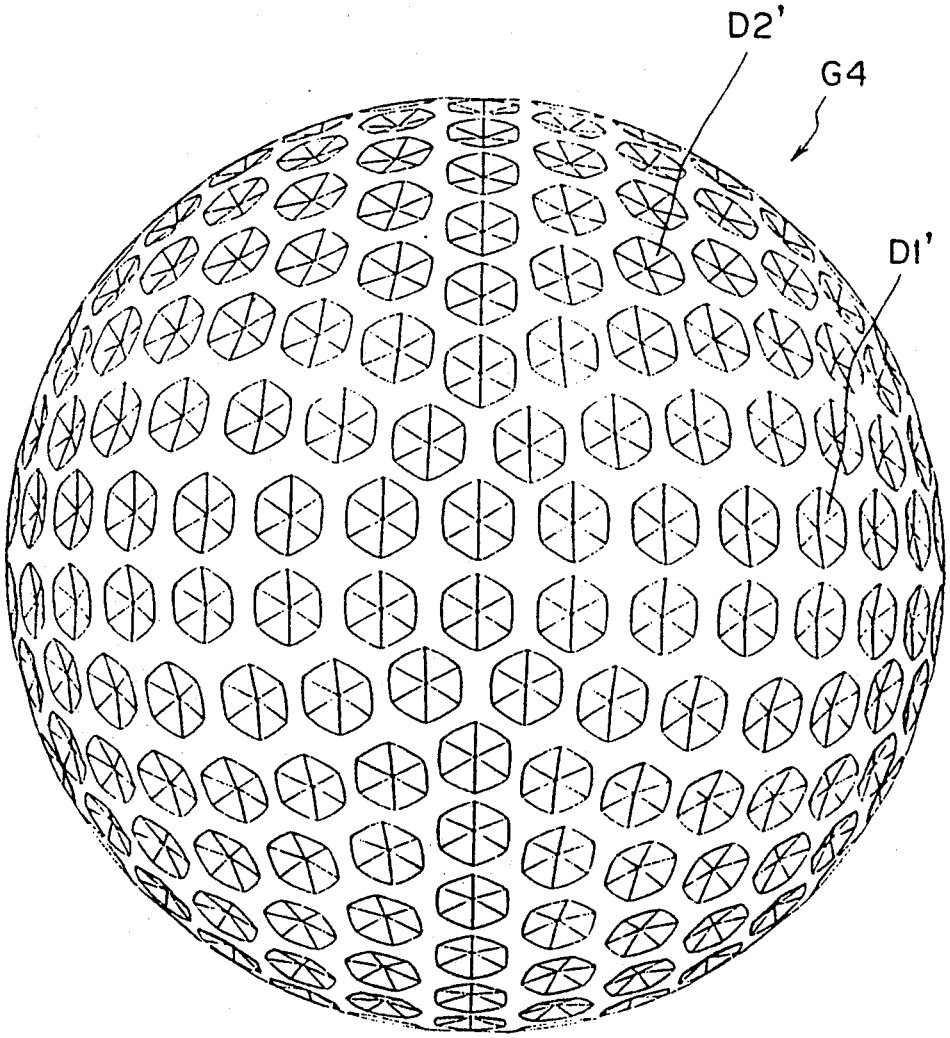
FIG. 15 is a front view showing a golf ball according to a second comparative example.
Figure 16:
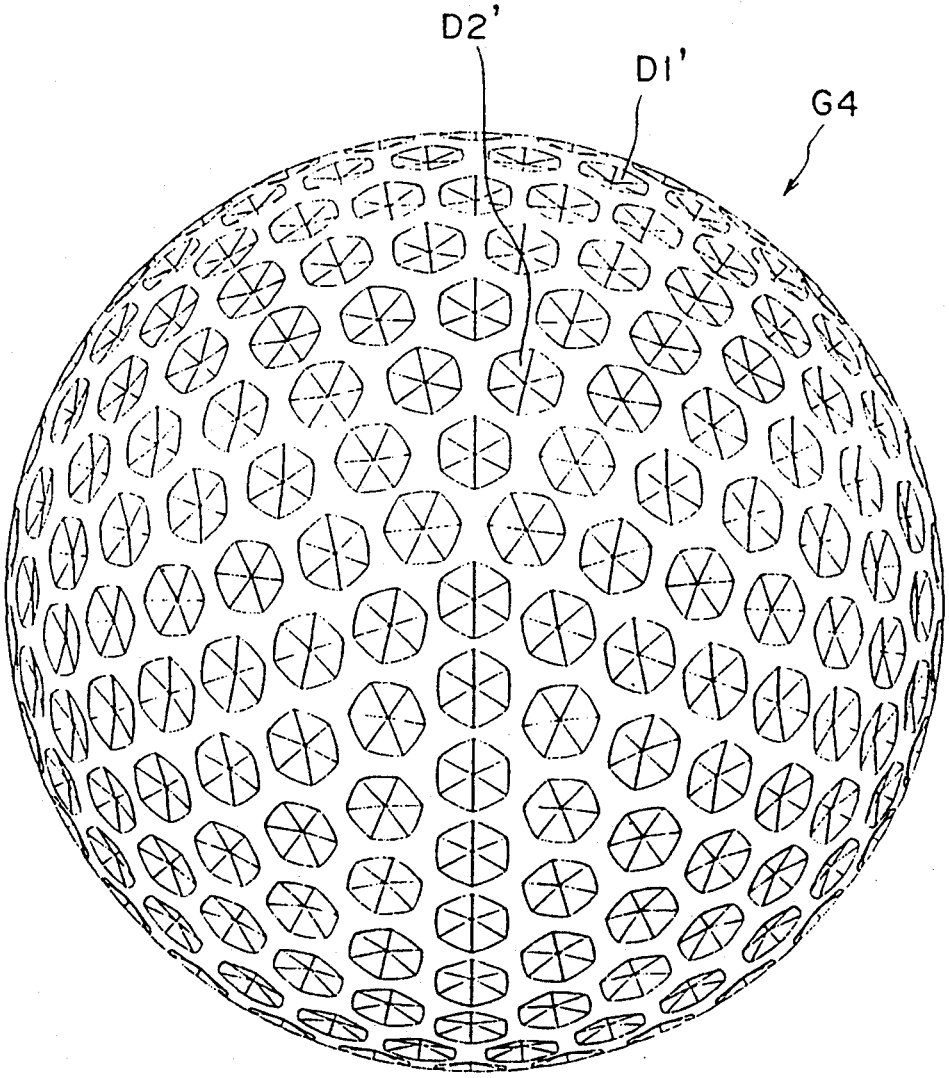
FIG. 16 is a plan view showing the golf ball according to the second comparative example.
Figure 17:
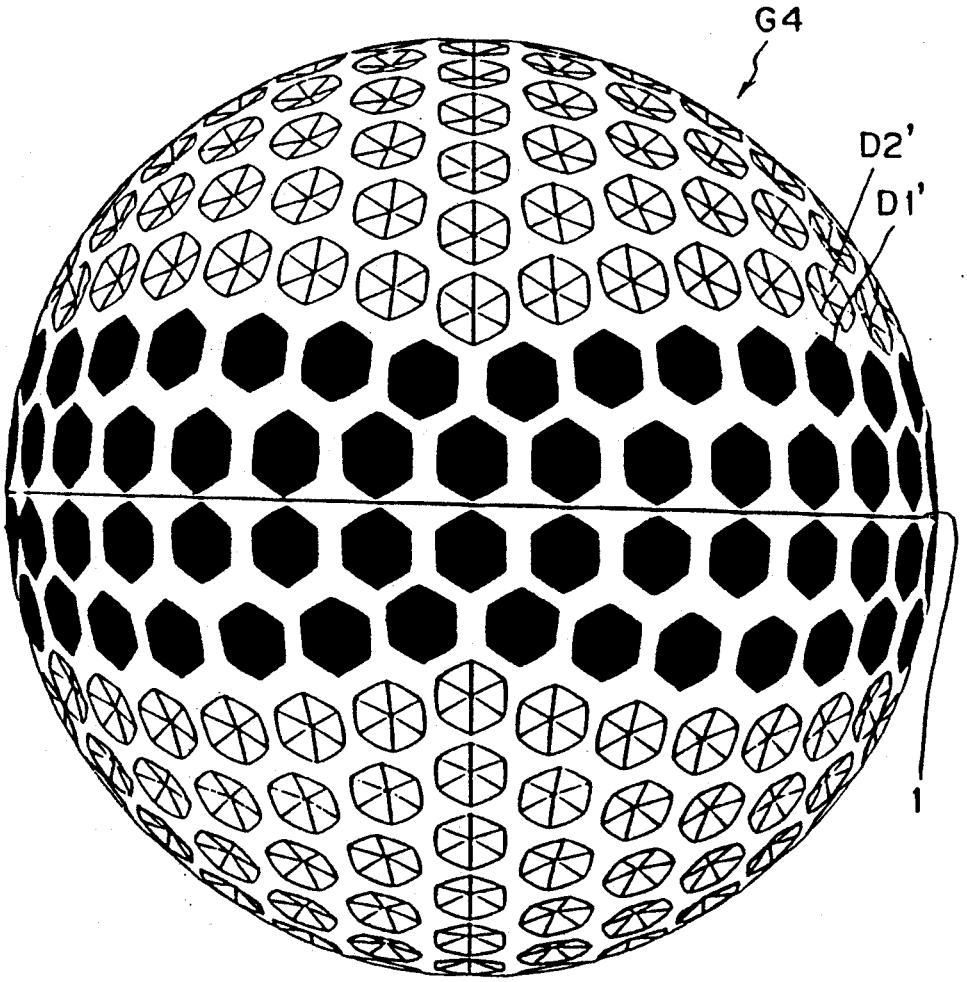
FIG. 17 is a front view showing the L spherical zone and the F spherical zone of the golf ball according to the second comparative example.

Referring to FIGS. 15, 16, and 17, a second comparative example golf balls G4 are described below. Dimples are arranged on the surface thereof based on regular icosahedral arrangement. The golf ball G4 has one great circle path corresponding to the parting line, similarly to the second embodiment. The central angle of each boundary circumference dividing the surface of the golf ball into two zones, the (L) spherical zone and the (F) spherical zone is set to $\theta=20°$. As shown in FIG. 17, dimples D1' arranged in (L) zone are As shown in Table 1, 120 dimples are arranged in the (L) zone and 212 dimples are arranged in the (F) zone of the golf ball G3, totalling 332 similarly to the second embodiment. All of 120 dimples arranged in the (L) zone are noncircular, namely, regular hexagonal. Similarly, all of 212 dimples arranged in the (F) zone are also noncircular, namely, regular hexagonal. That is, only noncircular dimples having the effect of making the air current highly turbulent are arranged both in (L) zone and (F) zones of the golf ball G4 of the second comparative example.

The golf balls of the first and second embodiments and the first and second comparative examples are each thread-wound and have a liquid center and a balata cover. They have the same composition and construction. The outer diameter thereof is all 42.70±0.03 mm and the compression thereof is all 95±2.

Experimental results of the first and second embodiment and the first and second comparative examples are described below.

Using a swing robot manufactured by True Temper Corp., tests for examining symmetrical property thereof were conducted. The test conditions were as follows:

Club used: driver (W1)
Head speed: 48.8 m/sec
Spin: 3500±300 rpm
Angle of elevation: 9°±0.5°
Wind: against, 0.9~2.7 m/s
Temperature of golf balls: 23°±1° C.

The number of golf balls prepared for each embodiment and comparative example was 40.

Under this condition, 20 balls were line-hit and 20 balls were face-hit. The averages of carries, trajectory heights (trajectory height means an angle of elevation viewed from a launching point of a golf ball to the highest point thereof in flight) and flight time were measured. The results are shown in Table 2 below.

TABLE 2

| | Symmetrical Characteristics Test | | | |
|---|---|---|---|---|
| | way of hitting | carry (yard) | trajectory height (DEG) | flight time (SEC) |
| first embodiment | line hitting | 237.4 | 13.72 | 6.10 |
| | face hitting | 238.4 | 13.76 | 6.10 |
| second embodiment | line hitting | 235.0 | 13.91 | 6.22 |
| | face hitting | 235.6 | 13.84 | 6.25 |
| first comparative example | line hitting | 231.1 | 13.29 | 5.77 |
| | face hitting | 237.4 | 13.70 | 6.05 |
| second comparative example | line hitting | 234.7 | 13.99 | 6.20 |
| | face hitting | 228.5 | 14.38 | 6.54 |

As clear from Table 2, according to the golf balls of the first and second embodiments, the carry, the trajectory height, and the flight time in line hitting were almost equal to those in face hitting.

As compared with the golf ball of the embodiments, according to the first comparative example golf balls, the trajectory height in line hitting was lower than that in face hitting and the flight time and the carry in line hitting were shorter than those in face hitting. This is because the percentage of noncircular dimples arranged in the (L) zone of the first comparative example golf balls is lower than that of uncircular dimples arranged in the (L) zone of the golf ball according to the first embodiment and consequently, in line hitting, the dimple effect of the first comparative example golf balls is smaller than that of the golf balls of the first embodiment.

Similarly, according to the second comparative example golf balls, the trajectory height in line hitting was lower than that in face hitting and the flight time in line hitting was shorter than those in face hitting. This is because the percentage of noncircular dimples arranged in the (F) zone of the second comparative example golf balls is much greater than that of uncircular dimples arranged in the (F) zone of the golf ball according to the first embodiment and consequently, in face hitting, the dimple effect of the second comparative example golf balls is too great. Noncircular dimples has the effect of making air current in the vicinity of the golf ball highly turbulent, but if they are arranged inappropriately on the surface of the golf ball as exemplified in the second comparative example golf balls, the golf ball has an unfavorable symmetrical property and consequently, its flight distance is short.

As apparent from the foregoing description, the golf balls according to the first and second embodiments has a more favorable aerodynamic property than the first and second comparative example golf balls and are small in difference in trajectory thereof irrespective of whether the golf ball rotates with back spin on a rotational axis, the circumference of which coincides with the great circle path or a rotational axis, or the circumference of which does not coincide with the great circle path.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball having dimples on the surface thereof and at least one great circle path which does not intersect the dimples in a spherical zone defined by said great circle to each circumference formed in correspondence with a central angle of less than approximately 15° with respect to said great circle, represented as an (L) spherical zone and a spherical zone other than said (L) spherical zone represented as an (F) spherical zone, whereby noncircular dimples are arranged in said (L) spherical zone in an amount more than 60% of all dimples arranged in said (L) spherical zone and circular dimples are arranged in said (F) spherical zone in an amount more than 60% of all dimples arranged in said (F) spherical zone.

2. The golf ball as claimed in claim 1, wherein the surface configuration of each of said noncircular dimples is a regular polygonal.

3. The golf ball of claim 1, wherein only noncircular dimples are arranged in the (L) zone while circular dimples are arranged more than noncircular dimples in the (F) zone.

* * * * *